US008398084B2

(12) United States Patent
Hall

(10) Patent No.: US 8,398,084 B2
(45) Date of Patent: Mar. 19, 2013

(54) BLACKJACK VARIATION WITH AUTOMATICALLY BURNED CARDS

(76) Inventor: Geoff Hall, Solihull (GB)

( * ) Notice: Subject to any disclaimer, the term of this patent is extended or adjusted under 35 U.S.C. 154(b) by 17 days.

(21) Appl. No.: 13/219,697

(22) Filed: Aug. 28, 2011

(65) Prior Publication Data

US 2012/0223482 A1 Sep. 6, 2012

Related U.S. Application Data

(60) Provisional application No. 61/448,189, filed on Mar. 1, 2011, provisional application No. 61/448,193, filed on Mar. 1, 2011, provisional application No. 61/448,642, filed on Mar. 2, 2011.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 7,036,821 | B2 | 5/2006 | Hall | |
| 7,435,172 | B2 | 10/2008 | Hall | |
| 7,506,874 | B2 | 3/2009 | Hall | |
| 2007/0052175 | A1 * | 3/2007 | McGurk et al. | 273/292 |
| 2007/0138744 | A1 | 6/2007 | Hall | |
| 2007/0284821 | A1 | 12/2007 | Hall | |
| 2008/0227537 | A1 | 9/2008 | Hall | |
| 2009/0170582 | A1 | 7/2009 | Hall | |
| 2009/0179380 | A1 * | 7/2009 | Hall | 273/292 |
| 2010/0167803 | A1 | 7/2010 | Hall | |
| 2011/0165926 | A1 | 7/2011 | Hall | |
| 2011/0165927 | A1 | 7/2011 | Hall | |
| 2011/0218023 | A1 | 9/2011 | Hall | |
| 2012/0071228 | A1 | 3/2012 | Hall | |
| 2012/0074647 | A1 | 3/2012 | Hall | |

* cited by examiner

*Primary Examiner* — Michael Dennis
(74) *Attorney, Agent, or Firm* — Muskin & Cusick LLC

(57) ABSTRACT

A method to implement a blackjack variation. The dealer is dealt an up-card and a hole-card. If the up-card is a 10-valued card, then the dealer peeks at the hole-card, and if the hole-card is also a 10-valued card, then the dealer will burn both the up-card and the hole-card (which are both 10-valued cards), and deal two additional cards to the dealer which become the dealer's hand. The game then proceeds normally.

21 Claims, 4 Drawing Sheets

BLACKJACK VARIATION WITH AUTOMATICALLY BURNED CARDS

CROSS REFERENCE TO RELATED APPLICATIONS

This application claims benefit to U.S. provisional application 61/448,189, filed on Mar. 1, 2011, which is incorporated by reference herein in its entirety. This application also claims benefit to U.S. provisional application 61/448,193, filed on Mar. 1, 2011, which is incorporated by reference herein in its entirety. This application also claims benefit to U.S. provisional application 61/448,642, filed on Mar. 2, 2011, which is incorporated by reference herein in its entirety.

BACKGROUND OF THE INVENTION

1. Field of the Invention

The present general inventive concept is directed to a method, apparatus, and computer readable storage medium directed to a blackjack variation that can be played in a casino or on the Internet.

2. Description of the Related Art

The casino game of blackjack is well known, for example see U.S. Patent publication 2003/0155715 which is incorporated by reference herein in its entirety.

FIG. 1 is a flowchart illustrating a method of implementing the known game of blackjack.

Points totals are computed by adding the standard rank value of each card, with face valued cards (tens, jacks, queens, kings) being given a value of 10, and aces being given a value of 1 or 11, whichever results in a better hand. A soft point total is where at least one ace is given the value of 11. A hard point total is a hand with all aces counting as 1.

In operation 100, the player makes a main wager by placing chips on a table. Then, in operation 102, the dealer deals two initial cards to each player (either face up or face down) and two initial cards to the dealer, typically one face down ("hole-card"), and one face up (the "up-card"). Then the player can decide whether to hit, stand, double, or split. If the player decides to hit, then the method proceeds to operation 106, which deals an additional card to a player. If a determination 108 determines that the player has busted (the player's hard point total is over 21), then the player loses the game and thus loses the main wager in operation 110, which ends the game. If the determination 108 determines that the player has not busted, then the method returns to operation 104, where the player can make another decision whether to hit or stand. In operation 104, the player can also double (not pictured) by place an additional wager of up to the main wager, but the player is limited to drawing only one additional card before the player must stand.

If the player stands and has not busted out (either stands on his or her initial two cards or draws cards but has a point total under 22 and then stands), then the method proceeds to operation 112, which reveals all dealer's cards (e.g., turns the hole-card face up) and which then plays out the dealer's hand according to predetermined rules. If the dealer's total is greater than a predetermined amount (typically 17), then the dealer stands (proceeds to operation 122). If the dealer's total is not greater than the predetermined amount, the method proceeds to operation 116 which deals an additional card to the dealer. If it is then determined 118 that the dealer has not busted (has a point total over 21), the method returns to operation 114. If the dealer has busted, then the player wins the game and the main wager in operation 120 (this assumes the player has not also busted; if the player has already busted then the player would have lost in operation 110).

In operation 122, both the player and the dealer have played out their hand and neither have busted. Thus, their respective point totals (adding the numerical values of each card in the hand) are compared. If the dealer's point total is determined in operation 124 to be lower than the player's point total, then the player wins the game and the main wager in operation 120. Otherwise, if the dealer's point total is determined 128 to be greater than the player's point total, then the player loses the game and the main wager in operation 130. If the player's point total ties the dealer's point total, then that results in a "push" in operation 126 in which the player doesn't win or lose the main wager (the main wager bet is a wash).

If a player is initially dealt two identically ranked cards in operation 102, players can also split in operation 104 by placing an additional split wager equal in value to the main wager, and the player's two initial cards are separated and the dealer deals an additional card on each. The player then plays out each of the two separate hands, each from operation 104. Depending on house rules, players may or may not be allowed to resplit cards.

One disadvantage of the prior art game of blackjack is that players get upset when the dealer is initial dealt a good hand (such as a point total of 20). What is needed is a new and entertaining version of blackjack which minimizes players' frustration by the dealer receiving good hands.

SUMMARY OF THE INVENTION

It is an aspect of the present invention to provide an exciting casino game.

The above aspects can be obtained by a method that comprises (a) providing a physical gaming table and a physical deck(s) of cards; (b) receiving a wager from a player; (c) dealing a player's hand and a dealer's hand comprising an up-card and a hole-card; (d) determining if the up-card is in a first set of one or more predetermined card values, and only if so, then determining if the hole-card is in a second set of one or more predetermined card values, and only if so, then burning the dealer's hand and redealing the dealer's hand; (e) completing the game according to predetermined blackjack rules; and (f) resolving the wager according to the predetermined blackjack rules.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
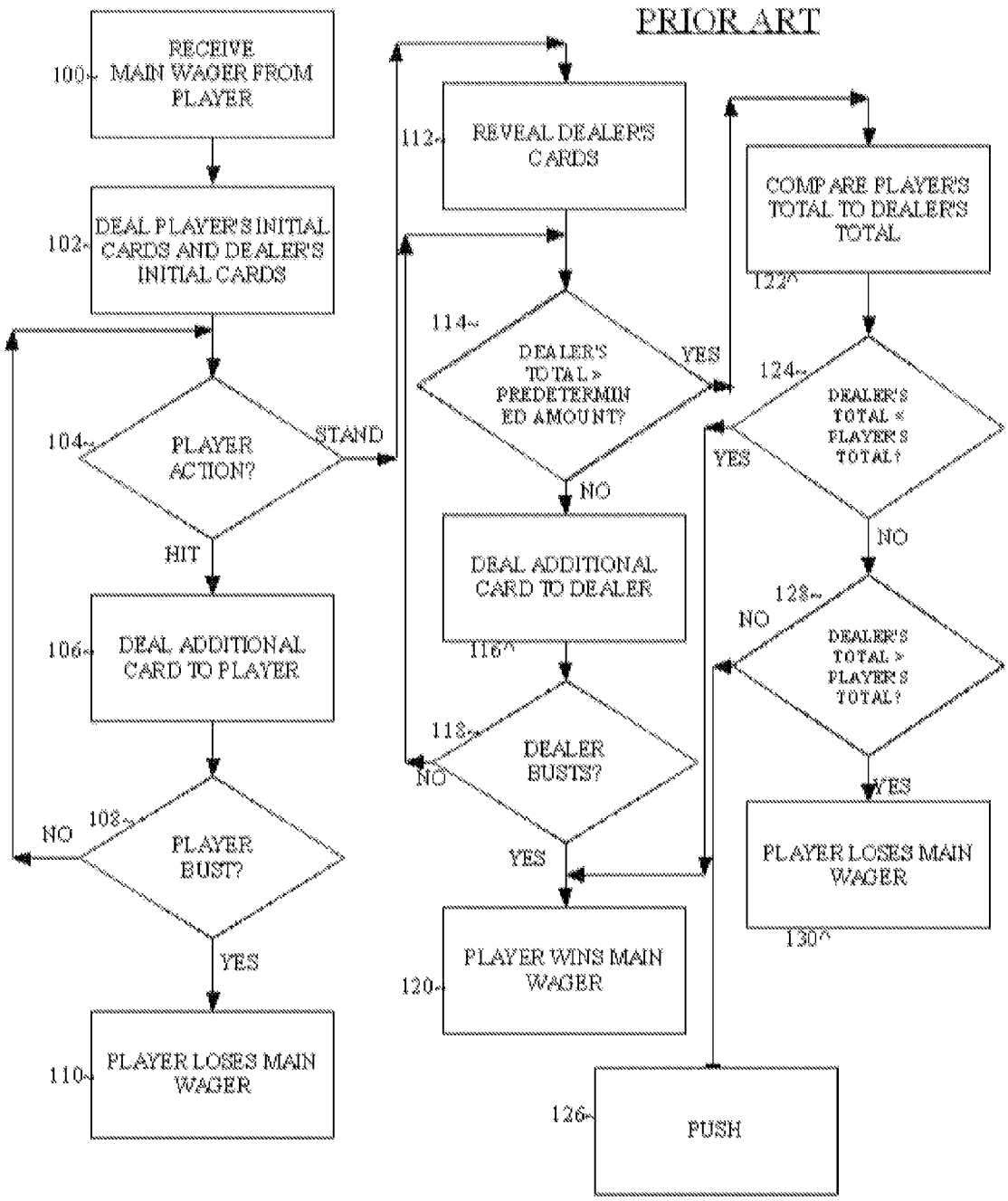
FIG. 1 is a flowchart illustrating a method of implementing the known game of blackjack.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a blackjack side bet.

FIG. 1 is a flowchart illustrating a method of implementing the known game of blackjack.

In general, casino blackjack is played by one or more players at a gaming table against a dealer using one or more decks of cards (each deck can be a standard 52 card deck). The idea is for the player to make a point total closest to 21 without going over 21 (busting). Each player (after making a main wager) is dealt two initial cards (typically face up) and the dealer is also dealt two cards (one face up—the upcard, and one face down—the hole card). The player can stand on his or her initial two cards, or continuously hit (take another card) until the player stands or the player's point total is over 21 (upon which the player automatically loses). If the player has not busted, then after the player stands the dealer will play out the dealer's hand according to predetermined rules. One set of dealer predetermined rules is as follows: the dealer will continuously hit until the dealer's point total is greater than 16. Once the dealer has resolved the dealer's hand, the wager is resolved. If the player has busted then the player loses (the main wager). If the player has not busted but the dealer has busted (the dealer's point total is over 21) then the player wins (wins even money on the main wager). If both the player and the dealer have not busted, then if the player's point total is higher than the dealer's point total then the player wins (wins even money on the main wager). If both the player and the dealer have no busted, then if the dealer's point total is higher than the player's point total then the dealer wins (the player loses the main wager). If the player's point total equals the dealer's point total, then the main wager pushes (neither wins nor loses). Other options the player may have at his or her disposal is to double down or split. Cards are given their standard numerical value (i.e., aces count as 1 or 11 (whichever makes the best hand), 2's-10's count as their respective face value, jacks, queens, and kings all count as 10).

The present inventive concept is a blackjack game that incorporates a "dealer burn procedure" in which a dealer will automatically burn the dealer's initial hand (initial two cards dealt) if the two cards are both 10-valued cards. The dealer will burn these two cards by removing the two dealer's cards and placing them into the discard rack, and then dealing the dealer two new cards (an up-card and a hole-card face down), and then the game is continued. In this manner, the dealer would be unlikely to have a point total of 20 (the only ways the dealer would have a point total of 20 is if the dealer has achieved the point total of 20 using more than two cards (e.g., 7, 8, 5), if the dealer burns two 10 cards (both the dealer's up-card and hole-card are 10-valued cards) only to receive another two card point total of 20, or if the dealer is dealt an ace and a 9).

Players would typically find this version of blackjack attractive because players do not like when the dealer receives a point total of 20 (because this means the dealer has a very strong hand. Thus, the dealer would be unlikely to have a point total of 20 and thus players would typically find the game less stressful when the player has a 10-showing. In addition, this would change the player strategy and provide the player more opportunities to double down and split since the dealer would have a point total of 20 with much less frequency than the prior art version of blackjack.

Figure 2:
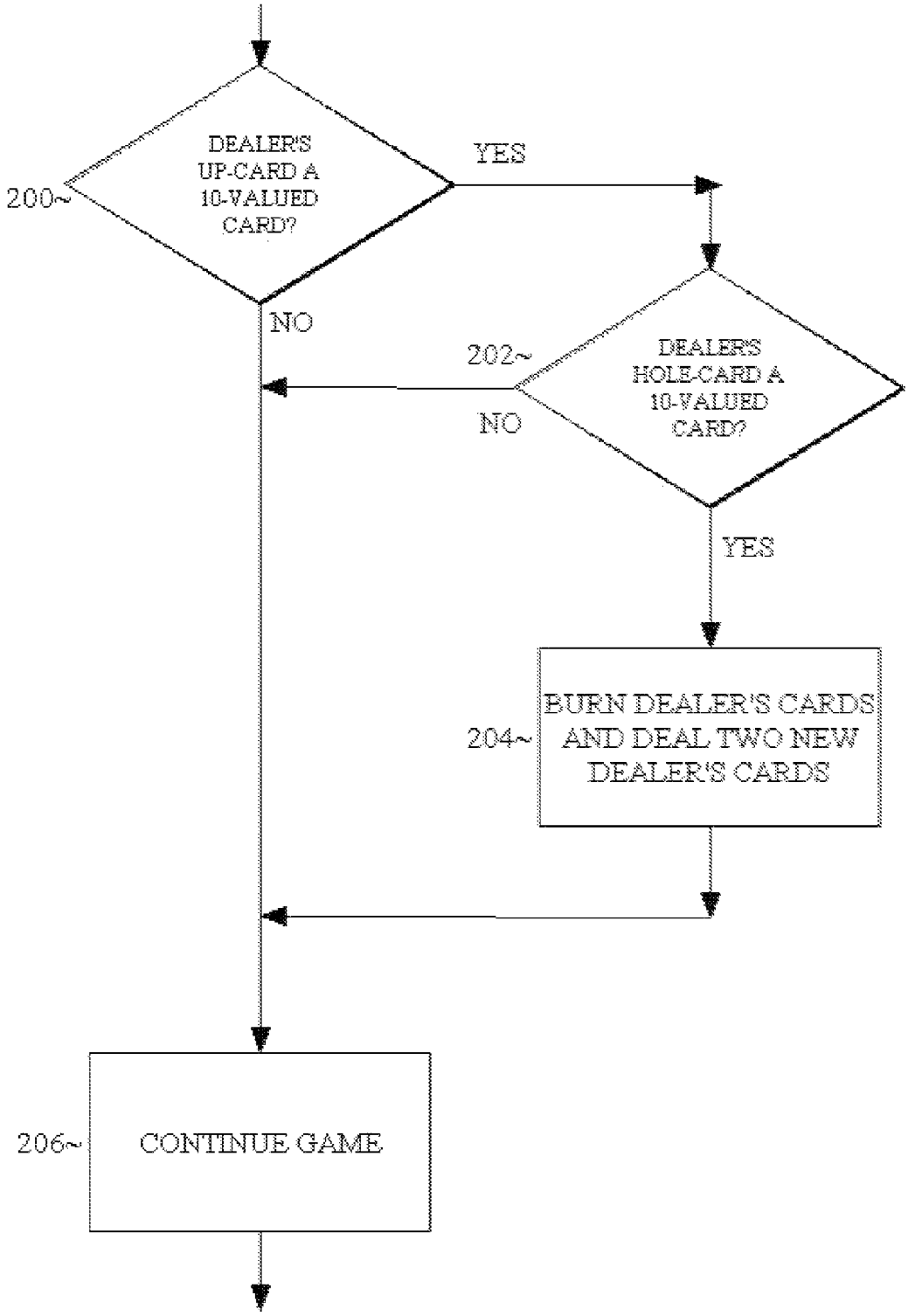
FIG. 2 is a flowchart illustrating an exemplary method of implementing a dealer burn procedure, according to an embodiment.

FIG. 2 is a flowchart illustrating an exemplary method of implementing a dealer burn procedure, according to an embodiment.

In a first embodiment, operations 200-206 can be performed in between operations 102-104 of FIG. 1 (i.e., insert FIG. 2 in between operations 102 and 104).

The dealer burn procedure would start with operation 200, which determines if the dealer's up-card is a 10-valued card (10, jack, queen, or king, with suits being irrelevant) and only a 10-valued card. Since up-cards are dealt up, this can be determined by visual inspection. If not, then the method proceeds to operation 206 which continues the game as if nothing has happened.

If in operation 200, the dealer's up-card is a 10-valued card, then the method proceeds to operation 202, which determines if the dealer's hole-card is a 10-valued card (and only a 10-valued card). The dealer can peek at the dealer's hole-card. This can be done in a number of ways. The dealer can physically peek at the hole-card by crimping the card and looking under without revealing the card to the players. Or, the dealer can use a mechanical (or electronic) hole-card reader which can determine if the hole-card is a 10-valued card (or other programmed value) without the dealer knowing the value of the card (unless the hole-card is a 10). Such a device is described in U.S. Pat. No. 5,681,039, which is incorporated by reference herein in its entirety. If the dealer's hole-card is not a 10-valued card, then the method proceeds to operation 206, which continues the game as if nothing has happened.

If in operation 202, it is determined that the dealer's hole card is a 10-valued card (meaning the dealer has a two-card point total of 20), then the method proceeds to operation 204, which burns the dealer's two cards (both the dealer's up-card and the dealer's hole-card) and deals (also known as "redealing") the dealer two new cards, one face up (upcard) and one face down (hole-card). These two new cards are then used as a compete replacement to the original dealer's two cards. The term "burn" generally means to discard the cards and not use them further when completing the game. What actually happens to the burned cards (e.g., whether they are placed in the discard rack or elsewhere is not important). The method then proceeds to operation 206. In an alternate embodiment, operation 204 would not burn and redeal both the dealer's initial two cards (as described above), but only one (either the up-card or the hole-card while keeping the other). Thus, for example, if the dealer had an up-card of 10 and a hole-card of 10, the dealer would burn the hole-card and redeal the hole card (e.g., a new card is dealt as the hole-card face down but the original up-card is kept, or alternatively a new card is dealt as the up-card while the same hole-card is kept). In this manner, the dealer keeps one 10-valued card but not both (although of course the redealed card could also be a 10 valued card).

From operations 200, 202, or 204 (depending on what happened during the procedure), the method continues to operation 206 which continues the blackjack game (e.g., the next operations in FIG. 1 can be performed such as operation 104).

It is noted that the method described above with regard to FIG. 2 is performed in between operations 102 and 104, so that if the dealer had two 10-valued cards as the up-card/hole-card) then they were both replaced with newly dealt random cards (a new up-card and a new hole-card). Note that if the dealer has an ace and 9 as the two initial cards, this would be a point total of 20 but would not be subjected to the burn/replacement (operation 204). Thus, the player will face a dealer's point total of 20 much less frequently than standard blackjack.

In a second embodiment of the game, operations 200-206 of FIG. 2 would be performed in between operations 112 to 114 of FIG. 1 (instead of in between operations 102 to 104 as described in the first embodiment). In this embodiment, the player would also face a dealer point total of 20 less frequently than standard blackjack, however, the player would have already made his or her playing decisions. Thus, for example, if the player had busted (achieved a point total greater than 21), then the player would still be out of the game regardless of whether the dealer burned the dealer's two cards or not. In this embodiment, it would not be necessary for the dealer to have to peek at the hole card (without the players seeing it) since the dealer's cards have already been revealed (in operation 112).

It is noted that FIG. 2 illustrates the concept of burn conditions. If the dealer's cards meet the burn conditions, then the dealer would burn the dealer's cards in operation 204. If the dealer's cards do not meet the burn conditions, then the dealer would not burn the dealer's cards. The burn conditions can remain constant throughout the game or they can change (e.g., after a first burn then the burn condition changes). Of course, after each game is over and a new game is dealt, the burn conditions are reset (in other words if a burn is performed in one game, it has no effect on a subsequent game).

The second embodiment could be applied to the "European hole card rule", wherein the dealer is not dealt a hole card but only an up-card in operation 102. After all of the players at the table have played out their respective hands, then the dealer deals himself/herself a second card face up in operation 112 (this would serve as the hole-card but there is no need now to deal it face down since all players have made their decisions). After the dealer's second card is dealt, then operations 200-206 are performed, and then the game can continue with operation 114.

In a further embodiment, from operation 204, the method would return to operation 200 (instead of proceeding to operation 206). In this manner, if the dealer burned two 10-cards (cards with a value of 10, e.g., any 10, jack, queen, and king) and the dealer again received two 10-cards, the dealer would burn the second two 10-cards (and all future two 10-cards) until the dealer was dealt two initial cards (up-card, hole-card) that was not two 10-cards (or does not meet the burn condition). In this embodiment, it would be impossible for the dealer to have an initial point total of 20 using two cards (unless the two cards are an ace and 9), although of course the dealer would still be able to achieve a point total of 20 using three or more cards). In a further variation of this embodiment, the dealer may burn a predetermined number of two 10 cards (e.g., two or three) before keeping the next two 10-cards. For example, a predetermined house rule may provide that the dealer will burn at most two two-10 cards (two different sets of initially dealt 10-cards), for example: if the dealer were dealt a first two 10 cards, burned that and dealt himself/herself another two 10-cards, the dealer would burn that one as well, and then if the dealer dealt himself/herself a third two 10-cards, the dealer would not burn that one but would have to keep it (because the dealer has reached the limit). This cap on burning hands avoids a potential "infinite loop" of continuing to burn cards from the shoe/deck.

It is noted that when implementing a subsequent burn procedure (as described above) wherein after an initial burn another burn procedure is implemented (going from operation 204 back to operation 200), the criterion for burning would remain the same. However, in an alternative embodiment, the criterion for burning in a subsequent burn can be different than the initial burn. For example, the criteria for an initial burn can be that the dealer's two initial cards are two 10-valued cards, and then the criteria for a subsequent burn is that the dealer's two new cards (after a burn the two new cards dealt to the dealer (not dealer's draw cards)) will be burned if both cards form a blackjack (one card is a 10 and the other card is an ace or vice-versa). Thus, for example, consider a game where the initial burn condition is that both dealer's initial cards are each 10-valued cards, and the subsequent burn condition is that both dealer's new cards are both 10-valued cards or form a blackjack. Thus, if the dealer is initially dealt an ace up and a 10 in the hole card, this would not be burned and play would continue normally. However, if the dealer is initially dealt a king and a jack (two 10-valued cards), then these would be burned and if the dealer is now dealt an ace up-card and a 10 in hole-card, these would be burned also and another new pair of dealer cards (up-card, hole-card) would be dealt to the dealer. Typically, all subsequent burn procedures (not including the initial burn procedure) would have the same burn conditions, although it is not required.

In another embodiment, the game can have a dealer burn condition which will burn the dealer's cards when either: a) both of the dealer's cards are 10-valued cards; or b) if the dealer's up-card is an 10-valued card and the dealer's hole-card is a suited ace (which matches the suit of the 10-valued up card) then these cards will be burned also. If the hole-card is not a suited ace (or a 10-valued card) then there would be no burn.

In yet a further embodiment, operation 200 would determine if the dealer's up-card is either a 10-valued card or an ace (instead of just a 10-valued card). In this embodiment, if the dealer has an ace-up blackjack (the dealer's hole-card is a 10-valued card) this would trigger a burn and deal (operation 204), thus reducing the frequency the dealer receives blackjack.

In yet a further embodiment, operation 200 would determine if the dealer's up-card is either 10-valued card or an ace (instead of just a 10-valued card) and operation 202 would: A) if the dealer's up-card is an ace—determine if the hole-card is 10-valued card; B) if the dealer's up-card is a 10-valued card—determine if the hole-card is either a 10-valued card or an ace. Another way of phrasing operations 200-202 would be to determine whether the dealer's initial two cards is either a blackjack or comprises two 10-cards. Only if one of these conditions is met (the dealer's initial two cards are either a blackjack or are two 10-cards) then operation 204 is performed. In this embodiment, it would not be possible for the dealer to be dealt a blackjack or two 10-cards without triggering a burn and deal (operation 204).

In a less preferred embodiment, operation 200 could check the dealer's hole-card and operation 202 could check the dealer's up-card.

The methods described herein provide the player with an advantage over standard blackjack in that the number of times the dealer receives an initial hand of 20 is reduced. Therefore, if a player were to play optimal strategy for this game, the player would have an advantage over the house. Thus, in order for the casino to profit from this game, an equalizing element must be added to the game in order so that the house advantage is maintained. One way this can be done is by implementing the game with a "push on 22" feature. This feature is described in U.S. Pat. No. 7,435,172, which is incorporated by reference herein in its entirety. In this embodiment, when the player has not busted and the dealer busts ("yes" from operation 118) with a dealer's point total of 22 (but not 23 or higher), the player's wager (made in operation 100) would push (instead of winning as in operation 120). Other dealer point totals besides 22 (e.g., 23, 24, 25, or 26) can be used to push the player's wager. This feature gives the house an additional advantage (since players would win more by winning instead of pushing). Alternatively, instead of using the "push on 22" feature as the equalizing element, other equalizing elements can be used as well. Some other known equalizing elements are paying even money on blackjacks, using a Spanish deck (a standard deck with all 10's removed), etc.

Table I below illustrates one sample set of rules. Of course any combination of rule changes can be used.

TABLE I

| | |
|---|---|
| 1. | The game is played using six standard 52-card decks. |
| 2. | To begin, the player makes a wager. |
| 3. | The dealer deals two cards face up to the player. He deals to himself, one card face up and one card face down. |
| 4. | If the dealer's up card is any 10, the dealer will peek at his hole card and burn both cards if he has either a suited blackjack or 20 points. The dealer will then deal two new cards to himself, one face up and one face down. After a first burn, with an ace or 10 up card, the dealer will peek at his hole card and burn both cards if he has either a blackjack (suited or off suit) or any two 10's. This process will continue until the dealer's hand does not consist of a blackjack or any two 10's. |
| 5. | The game then proceeds using the following blackjack rules:<br>a) Blackjacks pay 3 to 2.<br>b) Players may double down on any two cards, including after splitting.<br>c) Players may re-split pairs any number of times, excluding aces.<br>d) Aces may be split once and receive one card only.<br>e) The dealer stands on soft 17's.<br>f) A dealer total of 22 points is considered a push against any player total of 21 or less. A player blackjack will still beat a dealer 22.<br>g) If the dealer's up card is an ace, players may take insurance for up to half of their wager. Insurance pays 2 to 1 if the dealer has blackjack. |

Any combination/set of rule variation can be used, possible rule variations include (but not limited) to: number of decks used (1, 2, 4, 6, 8, or continuous shuffling machine); blackjack pays 6:5 vs. 3:2 vs. 1:1; dealer hits soft 17's (vs. stands on soft 17's); the player is allowed to double on any number of cards (vs. being allowed to double on only the first two cards); the player is allowed to re-split aces (vs. not being allowed to re-split aces); the player is allowed to re-split pairs any number of times (vs. only being allowed to split pairs one, twice, three times, or other number); the player is allowed to surrender (except when the dealer has blackjack) their first to cards in exchange for receiving 50% of their bet back (vs. not being allowed to surrender); a dealer bust on 22 could push the player's live bets (instead of pay them) vs. any other mechanism to give the house an advantage.

It is noted that if the criteria for burning is that the two dealer's cards are each 10-valued cards, then an ace and a 9 would not be burned (because this is not two 10-valued cards, even though it totals 20). However, in an alternative embodiment, a condition for burning can be used where the first two dealer's cards total 20 (regardless of their composition), and in this embodiment, all 20's would be burned (even using an ace and a 9).

Table II below is an example of a set of burn conditions (both initial for the first two dealer's cards and subsequent for after the dealer's first burn) that can be used. Of course, numerous such conditions can be devised and implemented. In some embodiments, there would be no subsequent burn conditions because all subsequent burn conditions would be the same as the initial burn conditions. In one embodiment, the dealer's cards can be burned a maximum of one time. In another embodiment, the dealer's card can be burned a maximum of a predetermined number of times (e.g., 3). In another embodiment, there is no limit to the number of times the dealer's cards can be burned (of course as long as the dealer's cards keep meeting the required burn conditions).

TABLE II

| |
|---|
| Initial burn condition:<br>a) if both dealer's cards are 10-valued cards; or<br>b) if the dealer's up-card is a 10-valued card and the dealer's hole-card is a suited ace; subsequent burn condition:<br>c) if both the dealer's cards are 10-valued cards; or<br>d) if both the dealer's cards form any blackjack. |

Table III below illustrates a set of complete rules for one embodiment of the game. Of course any rule variation/combination can be used. In addition, initial and subsequent burn conditions (what triggers a burn) can be identical or different and can comprise any of the conditions described herein (or any others not described herein). If the dealer's cards do not meet the burn conditions then the dealer does not perform a burn and play continues using blackjack rules. Note that even though a dealer total of 22 pushes all live bets on the table (where the dealer did not bust), player blackjacks still win. While the below rules state that aces can be split only once, in other embodiments aces can be split more than once (and up to four times in an embodiment). Dealers can also stand on soft 17 in another embodiment. Note also that if the dealer does not have a predetermined up-card which triggers a dealer peek at the dealer's hole-card then the dealer would not peek at the dealer's hole-card (because the dealer would have no reason to peek because a burn would be impossible). "Suited ace" in Table III refers to the same suit as the 10-up card.

TABLE III

| |
|---|
| On the initial deal: with a 10-up, dealer peeks and only burns: another 10 or a suited ace; |
| After a first burn: with a 10-up, dealer peeks and only burns: another 10 or any ace; |
| After a first burn: with an ace-up, dealer peeks and only burns: any 10. |
| Player are allowed to double on any number of cards |
| One card to resplit aces |
| Aces split only once |
| Blackjacks pay 3/2 |
| Players are allowed to double after splitting |
| Players are allowed to take Insurance against a dealer Ace |
| Dealer will hit soft 17 |
| Dealer will push all bets on a total of 22 (except player blackjacks will still win) |

Figure 3:
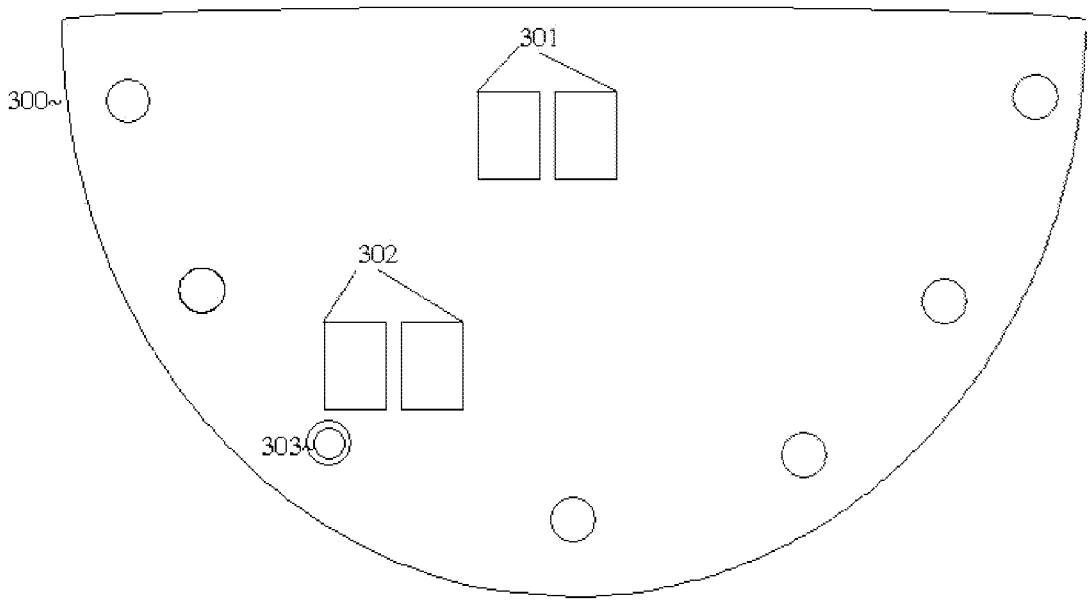
FIG. 3 is a drawing illustrating a gaming table, according to an embodiment.

FIG. 3 is a drawing illustrating a gaming table, according to an embodiment.

A physical gaming table (typically made of wood with felt on top with the layout imprinted on it) is used to play the game in a casino. Such a table can accommodate any number of players (such as seven as illustrated) or any other number (e.g. 2-10). All players play simultaneously against the dealer as known in the art. A player's hand 302 and a dealer's hand 301 are shown. A player's wager 303 is shown in the form of a chip or chips.

While not shown, the game can also be offered with any type of additional side bet in order to generate more action for the casino and more excitement for the players.

Figure 4:
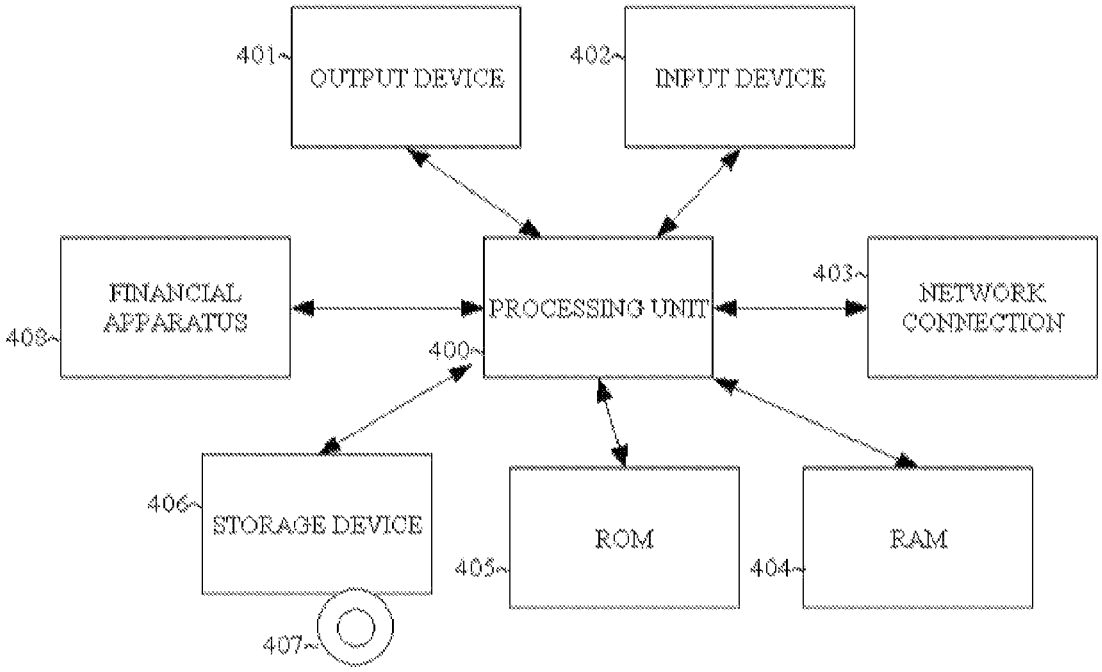
FIG. 4 is a block diagram illustrating exemplary hardware that can be used to implement an electronic version of the methods described herein.

FIG. 4 is a block diagram illustrating hardware that can be used to implement electronic versions of the wagering methods described herein, according to an embodiment. The hardware can be, for example, an electronic gaming machine (EGM) used in casinos. The hardware can also be a personal computer, playing the game using the Internet at an Internet casino for real money. The hardware can also be a digital casino table, for example the kind described in U.S. Pat. No. 7,775,887, which is incorporated by reference herein in its entirety.

A processing unit 400 (such as a microprocessor and any associated components) is connected to an output device 401 (such as an LCD monitor, touch screen, CRT, etc.) and an input device 402 (e.g., buttons, a touch screen, a keyboard, mouse, etc.) All methods described herein can be performed by the processing unit 400 by loading and executing respective instructions. The processing unit 400 can also be connected to a network connection 403, which can connect the electronic gaming device to a computer communications network such as the Internet, a LAN, WAN, etc. The processing unit 400 is also connected to a RAM 404 and a ROM 405. The processing unit 400 is also connected to a storage device 406 which can be a DVD-drive, CD-ROM, flash memory, etc. A computer readable storage medium 407 can store a program which can control the electronic device to perform any of the methods described herein. The processing unit 400 can also be connected to a financial apparatus 408 which can receive cash and convert the received cash into playable credits for use by the player when playing the electronic device. When the player decides to cash out any remaining credits, the financial apparatus 408 can issue coins or a cashless ticket (voucher) for the remaining credits which is redeemable by the player.

An example of the game will now be presented to help illustrate the game. Bob bets (operation 100) $1 and is dealt (operation 102) a 5-diamonds/ace-spades (note that typically in standard blackjack the suits are not relevant). The dealer is dealt (operation 102) an up-card of 9-hearts and a face down hole-card. Since the up-card is not a 10-valued card, the game continues normally. Bob hits (operation 106) and receives a 3-hearts. The dealer turns over the hole-card (operation 112) which is a 9-spades. Since Bob's point total of 19 beats the dealer's point total of 18, Bob wins (operation 120) and is paid $1 and Bob's original $1 wager remains (thus Bob can remove $2 from the table for a net profit of $1).

As another example, Sara bets (operation 100) $1 and is dealt (operation 102) a 2-clubs/8-diamonds, and the dealer is dealt (operation 102) an up-card of 10-hearts and a face down hole-card. Since it is determined (operation 200) that the up-card is a 10-valued card, the dealer peeks (operation 202) at the hole-card (operation 202) and determines (operation 202) that the hole-card is a 10-clubs. Since the dealer has an initial hand of two 10-cards, the dealer turns over (operation 204, part of the burn) the hole-card to reveal to all of the players the dealer's hand, then the dealer burns (operation 204) the two card hand of 20 (typically by placing these two cards in the discard rack), and the dealer now deals (operation 204) the dealer a new up-card (of 5-diamonds) and hole-card. Sara now decides to double (operation 104, doubling not pictured) and places another $1 wager up and is dealt a 5-clubs. The dealer now reveals (operation 112) the hole-card to be a 10-spades and the dealer hits and receives a 5-spades. Since the dealer's total of 20 is higher than Sara's total of 15, Sara loses (operation 130) both $1 wagers (for a total of $2) and these $2 in wagers are taken by the dealer and kept by the house.

It is further noted that other card values for the determinations in operations 200 and 202 can be used (other than those described above). For example, card values can be checked for different values (individual values or a set of different values) in combination with suits, colors, etc.

It is noted that the methods described herein can be played with any number of standard decks of 52 cards (e.g., 1 deck to 10 decks). Cards can be shuffled or a continuous shuffling machine (CSM) can be used. A standard deck of 52 cards can be used, as well as other kinds of decks, such as Spanish decks, decks with wild cards, etc. The operations described herein can be performed in any sensible order. Furthermore, numerous different variants of house rules can be applied.

Methods described herein can also be played on a physical table using physical cards and physical chips used to place wagers. Such physical chips can be directly redeemable for cash. When a player wins (dealer loses) the player's wager, the dealer will pay that player a respective payout amount. When a player loses (dealer wins) the player's wager, the dealer will take (collect) that wager from the player and typically place those chips in the dealer's chip rack.

Initial cash deposits can be made into the electronic gaming machine which converts cash into electronic credits. Wagers can be placed in the form of electronic credits, which can be cashed out for real coins or a ticket (e.g., ticket-in-ticket-out) which can be redeemed at a casino cashier or kiosk for real cash and/or coins.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All variations and features described herein can be combined with any other features described herein without limitation.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method for implementing a blackjack game, the method comprising: executing computer readable instructions on an electronic processing unit, the processing unit connected to an electronic input device and an electronic output device, the computer readable instructions performing the following operations; receiving a wager from a player; dealing a player's hand and a dealer's hand comprising an up-card and a hole-card; providing predetermined bum rules that comprise: determining if the up-card is in a first set of at least one predetermined card value, and only if so, then determining if the hole-card is in a second set of at least one predetermined card value, and only if so, then burning the dealer's hand and redealing the dealer's hand; implementing the predetermined burn rules; completing the game according to predetermined blackjack rules; and resolving the wager according to the predetermined blackjack rules.

2. The method as recited in claim 1, wherein the first set consists only of 10-valued cards, and the second set consists only of 10-valued cards.

3. The method as recited in claim 1, wherein the first set consists only of 10-valued cards and the second set consists only of 10-valued cards and aces.

4. The method as recited in claim 1, wherein the second set consists only of 10-valued cards and the first set consists only of 10-valued cards and aces.

5. The method as recited in claim 1, wherein the first set consist of only 10-valued cards and the second set consists of aces suited to match a suit of the up-card.

6. The method as recited in claim 1, wherein after the implementing, the dealer resolves the player's hand after receiving a decision by the player of what action to take.

7. The method as recited in claim 1, wherein before the implementing, the dealer resolves the player's hand after receiving a decision by the player of what action to take.

8. The method as recited in claim 1, wherein after the redealing is performed, then subsequently implementing the predetermined burn rules.

9. The method as recited in claim 8, wherein the predetermined burn rules are modified during the subsequently implementing of the predetermined burn rules.

10. The method as recited in claim 9, wherein the first set consists of only 10 valued-cards and the second set consists of aces suited to match a suit of the up-card, and for the subsequently implementing, the first set consists of all 10 valued cards and aces, and the second set consists of all 10 valued cards and aces when the up-card is a 10-valued card and the second set consist of all 10-valued cards when the up-card is an ace.

11. An electronic apparatus for implementing a blackjack game, the apparatus comprising:

an input device and an output device;

a processing unit operationally connected to the input device and the output device, the processing unit configured to execute instructions that perform:

receiving a wager from a player;

dealing a player's hand and a dealer's hand comprising an up-card and a hole-card;

determining if the up-card is in a first set of at least one predetermined card value, and only if so, then evaluating if the hole-card is in a second set of at least one predetermined card value, and only if so, then burning the dealer's hand and redealing the dealer's hand;

completing the game according to predetermined blackjack rules; and resolving the wager according to the predetermined blackjack rules.

12. The apparatus as recited in claim 11, wherein the first set consists only of 10-valued cards, and the second set consists only of 10-valued cards.

13. The apparatus as recited in claim 11, wherein the first set consists only of 10-valued cards and the second set consists only of 10-valued cards and aces.

14. The apparatus as recited in claim 11, wherein the second set consists only of 10-valued cards and the first set consists only of 10-valued cards and aces.

15. The method as recited in claim 11, wherein the first set consist of only 10-valued cards and the second set consists of aces suited to match a suit of the up-card.

16. The apparatus as recited in claim 11, wherein after the determining, the dealer resolves the player's hand after receiving a decision by the player of what action to take.

17. The apparatus as recited in claim 11, wherein before the determining, the dealer resolves the player's hand after receiving a decision by the player of what action to take.

18. A method for implementing a blackjack game, the method comprising:

allowing the following operations to be performed on an electronic computer connected to an electronic output device:

placing a wager by a player using the electronic computer;

viewing, by the player on the electronic output device, a player's hand and a dealer's hand comprising an up-card and a hole-card;

watching, by the player, the electronic computer implement predetermined burn rules that comprise: determining if the up-card is in a first set of at least one predetermined card value, and only if so, then determining if the hole-card is in a second set of at least one predetermined card value, and only if so, then burning the dealer's hand and redealing the dealer's hand;

viewing, by the player, the electronic computer complete the game according to predetermined blackjack rules; and viewing, by the player, the electronic computer resolve the wager according to the predetermined blackjack rules.

19. The method as recited in claim 18, wherein the player has connected the electronic computer to an online casino hosting the game.

20. A method for implementing a blackjack game, the method comprising:

allowing the following operations to be performed on an electronic computer connected to an electronic output device:

placing a wager by a player using the electronic computer;

viewing, by the player on the electronic output device, a player's hand and a dealer's up-card;

playing out, by the player, the player's hand;

viewing, by the player on the electronic output device, a second dealer's card face up;

watching, by the player, the computer implement predetermined burn rules comprising determining if the up-card is in a first set of at least one predetermined card value, and only if so, then determining if the dealer's second card is in a second set of at least one predetermined card value, and only if so, then burning the dealer's up-card and the dealer's second dealer's card and redealing the dealer's up-card and dealer's second card;

viewing, by the player, the electronic computer complete the game according to predetermined blackjack rules; and viewing, by the player, the electronic computer resolve the wager according to the predetermined blackjack rules.

21. The method as recited in claim 20, wherein the player has connected the electronic computer to an online casino hosting the game.

* * * * *